US011306561B2

(12) United States Patent
Franklin et al.

(10) Patent No.: US 11,306,561 B2
(45) Date of Patent: Apr. 19, 2022

(54) PRESSURE INTEGRITY TESTING OF ONE-TRIP COMPLETION ASSEMBLY

(71) Applicant: Weatherford Technology Holdings, LLC, Houston, TX (US)

(72) Inventors: Andrew Franklin, Leicestershire (GB); Euan Murdoch, Leicestershire (GB); Christopher Munro, Leicestershire (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 149 days.

(21) Appl. No.: 16/611,464

(22) PCT Filed: May 22, 2018

(86) PCT No.: PCT/GB2018/051376
§ 371 (c)(1),
(2) Date: Nov. 6, 2019

(87) PCT Pub. No.: WO2018/215747
PCT Pub. Date: Nov. 29, 2018

(65) Prior Publication Data

US 2020/0141211 A1 May 7, 2020

(30) Foreign Application Priority Data

May 25, 2017 (GB) ..... 1708389

(51) Int. Cl.
*E21B 34/14* (2006.01)
*E21B 34/06* (2006.01)
(Continued)

(52) U.S. Cl.
CPC ..... *E21B 34/14* (2013.01); *E21B 34/066* (2013.01); *E21B 43/10* (2013.01); *E21B 33/12* (2013.01);
(Continued)

(58) Field of Classification Search
CPC ..... E21B 34/14; E21B 43/10; E21B 34/066; E21B 2200/04; E21B 2200/05; E21B 2200/06; E21B 33/12; E21B 34/108
See application file for complete search history.

(56) References Cited

U.S. PATENT DOCUMENTS 8,833,469 B2 * 9/2014 Purkis ..... E21B 33/12 166/373
9,051,810 B1 * 6/2015 Cuffe ..... E21B 43/26
(Continued)

FOREIGN PATENT DOCUMENTS

CN 104832127 B 9/2017
EP 2098682 A2 9/2009
(Continued)

OTHER PUBLICATIONS

Combined Search and Examination Report in counterpart UK Appl. GB1708389.0, dated Oct. 17, 2017, 8-pgs.
(Continued)

*Primary Examiner* — Michael R Wills, III
(74) *Attorney, Agent, or Firm* — Blank Rome LLP

(57) ABSTRACT

A completion assembly defines a throughbore and comprises an isolation valve configurable between an open state (permitting fluid to flow through the throughbore) and a closed state (preventing fluid from flowing through the throughbore). A method for use in installing the assembly into a wellbore in a single trip comprises running the assembly into the wellbore with the valve in the open state until a downhole end of the assembly reaches a target position; injecting a fluid through the throughbore and the valve when the valve is in the open state; configuring the valve into the closed state; and performing a pressure integrity test of the throughbore above the valve. The valve is configurable between the open and closed states without any requirement for the valve
(Continued)

to be mechanically engaged by an activation member or a tool whilst the valve receives power from a power source.

22 Claims, 4 Drawing Sheets

(51) Int. Cl.
*E21B 43/10* (2006.01)
*E21B 33/12* (2006.01)
*E21B 34/10* (2006.01)

(52) U.S. Cl.
CPC ..... *E21B 34/108* (2013.01); *E21B 2200/04* (2020.05); *E21B 2200/05* (2020.05); *E21B 2200/06* (2020.05)

(56) References Cited

U.S. PATENT DOCUMENTS

| | | | | |
|---|---|---|---|---|
| 9,085,954 | B2 * | 7/2015 | Purkis | E21B 47/13 |
| 9,359,890 | B2 * | 6/2016 | Purkis | E21B 47/13 |
| 2006/0196675 | A1 | 9/2006 | Patel et al. | |
| 2010/0200225 | A1 | 8/2010 | Abdelmalek et al. | |
| 2010/0200243 | A1 * | 8/2010 | Purkis | E21B 47/12 166/373 |
| 2015/0252652 | A1 * | 9/2015 | Murdoch | E21B 34/06 166/250.01 |

FOREIGN PATENT DOCUMENTS

| | | | |
|---|---|---|---|
| EP | 2209967 | A2 | 7/2010 |
| GB | 2388619 | A | 11/2003 |
| GB | 2402954 | A | 12/2004 |
| GB | 2457979 | A | 9/2009 |
| GB | 2508710 | A | 11/2014 |
| WO | 2017/105958 | A1 | 6/2017 |

OTHER PUBLICATIONS

Int'l Preliminary Report on Patentability in PCT Appl. PCT/GB2018/051376, 18-pgs.
Int'l Search Report and Written Opinion in PCT Appl. PCT/GB2018/051376, dated Jul. 12, 2018, 13-pgs.
Error in Search Report n counterpart UK Appl. GB1 708389.0, dated Oct. 27, 2017, 3-pgs.

* cited by examiner

PRESSURE INTEGRITY TESTING OF ONE-TRIP COMPLETION ASSEMBLY

FIELD

The present disclosure relates to a method for use in installing a completion assembly in a wellbore in a single trip into the wellbore and, in particular, though not exclusively for use in installing a completion assembly in a wellbore of an oil or gas well.

BACKGROUND

Known completion methods in oil and gas wells involve the installation of a generally tubular completion assembly within a wellbore, the completion assembly defining a throughbore which extends from a surface level, such as a ground surface level or a seabed surface level, to a lower end or toe of the completion assembly within the wellbore. The completion assembly typically includes generally tubular upper and lower completion assemblies, the upper and lower completion assemblies together defining the throughbore. The lower completion assembly typically includes a base pipe and one or more ports through a side wall of the base pipe. The lower completion assembly also generally includes axially spaced packers located around the base pipe so as to define one or more zones in the annulus along the lower completion assembly. The upper completion assembly connects an upper end of the lower completion assembly to surface level and typically includes a base pipe, one or more packers located around the base pipe and one or more valves. In such conventional completion methods, the upper and lower completion assemblies are typically run and commissioned separately. This may add to the time and cost of completing a well.

When running a lower completion assembly into a wellbore, it is conventional to circulate fluid from surface level through the throughbore and out of a wash shoe installed at the toe of the lower completion assembly to assist the lower completion assembly to reach a desired target depth such as a desired total depth within the wellbore. The circulation of fluids in this way during installation is generally known as "washdown". For example, it is known to perform washdown by circulating fluid through a removable washpipe which is located within the throughbore so as to effectively by-pass the ports of the lower completion assembly, thereby allowing the ports to be open during installation of the lower completion assembly. However, the use of washpipe in this way generally requires a further trip or intervention to remove the washpipe from the wellbore before wellbore operations can be performed, thereby increasing the time and cost associated with completion of the well.

Lower completion assemblies have also been developed which include check valves which are configured to permit fluid to flow through the ports into the throughbore but to prevent the flow of fluid from the throughbore out through the ports. Although the use of check valves may avoid any requirement to use washpipe and therefore to remove washpipe from the wellbore after washdown, the use of check valves may preclude the possibility that the well may be converted from a production well to an injection well during the later life of the well. In addition, check valves may not be robust or reliable enough to withstand the high pressures existing in the throughbore during subsequent wellbore operations. This is because such conventional completion methods may rely upon use of an isolation valve at the toe of the completion assembly to be closed once the completion assembly reaches total depth to permit subsequent pressure testing of the completion assembly and/or hydraulic setting of the packers of the completion assembly, which isolation valve is closed in response to mechanical engagement of the isolation valve by an activation member such as a ball, dart or the like which is circulated from surface along the throughbore. However, such isolation valve mechanical activation methods generally rely upon the use of high pressures in the throughbore to shear retaining features. Consequently, the use of such isolation valve mechanical activation methods may be incompatible with, or may be unreliable when using, lower completion assemblies which have check valves which are more likely to fail or rupture unintentionally at the high pressures required to shear the retaining features.

Legislation is some jurisdictions may require certain well barriers to be in place to protect surface assets. Thus, the use of lower completion assemblies which include check valves may be less preferred in some jurisdictions because the check valves may effectively prevent the liner from becoming a barrier. Accordingly, lower completion assemblies which include hydro-mechanical port valves or port plugs such as rupturable port plugs or chemically dissolvable port plugs may be preferred in such jurisdictions. However, the use of isolation valve mechanical activation methods may also be incompatible with, or may be unreliable when using, lower completion assemblies which have such hydro-mechanical port valves or port plugs such as rupturable port plugs or chemically dissolvable port plugs as such port valves or port plugs may be liable to fail or rupture unintentionally at the high pressures required to shear the retaining features.

In addition, such isolation valve mechanical activation methods require a fluid circulation path to be established within the wellbore to permit the activation member to travel from surface level to the isolation valve at the toe of the completion assembly and this may interfere with, or upset, fluid displacements within the wellbore.

SUMMARY

It should be understood that any one or more of the features of one of the following aspects may be used in combination with any one or more of the features of any of the other following aspects.

According to an aspect of the present disclosure there is provided a method for use in installing a completion assembly in a wellbore in a single trip into the wellbore, the completion assembly defining a throughbore and the completion assembly comprising an isolation valve which is configurable between an open state in which the isolation valve permits fluid to flow through the throughbore and a closed state in which the isolation valve prevents fluid from flowing through the throughbore, and the method comprising: running the completion assembly into the wellbore with the isolation valve in the open state until a downhole end of the completion assembly reaches a target position in the wellbore; injecting a fluid through the throughbore and the isolation valve when the isolation valve is in the open state; configuring the isolation valve into the closed state; and performing a pressure integrity test of the throughbore above the isolation valve, wherein the isolation valve is configurable between the open and closed states without any requirement for the isolation valve to be mechanically engaged by an activation member or a tool whilst the isolation valve receives power from a power source.

The use of such an isolation valve which is configurable between the open and closed states without any requirement for the isolation valve to be mechanically engaged by an activation member or a tool in this way, not only facilitates "washdown" of the completion assembly to total depth within the wellbore in a single trip, but also enables one or more pressure integrity tests of the throughbore to be performed when the downhole end of the completion assembly is located at one or more intermediate positions as the completion assembly is run towards or into the wellbore without relying upon high fluid pressures in the throughbore for actuation of the isolation valve. Performing one or more such pressure integrity tests of the throughbore in this way may allow any problems with the completion assembly to be identified and remedied before the completion assembly reaches total depth in the wellbore. This may reduce the risk of the completion assembly reaching total depth in the wellbore only to discover that pressure integrity is not sufficient to allow packers to be set in the wellbore or so as to compromise fluid displacement in the wellbore. Performing one or more such pressure integrity tests of the throughbore in this way may, therefore, potentially result in a substantial savings in operational time and costs.

The method may comprise injecting the fluid through the throughbore and the isolation valve when the isolation valve is in the open state before, during and/or after running the completion assembly towards or into the wellbore.

When the downhole end of the completion assembly is located at the target position, the completion assembly may extend from a head of the wellbore to the target position.

The method may comprise running the completion assembly with the isolation valve in the open state from a head of the wellbore until the downhole end of the completion assembly reaches the target position in the wellbore in a single trip into the wellbore.

The target position may correspond to any one of: a position before, in, or after, a rotary table; a position before, in, or after, a riser; a position before, in, or after, a blow-out preventer; a position before, in, or after, a tubing hanger; a position before, in, or after, a cased section of the wellbore; a position before, in, or after, an open hole section of the wellbore; and a desired final position of the downhole end of the completion assembly in the wellbore.

The desired final position of the downhole end of the completion assembly in the wellbore may correspond to the position of the downhole end of the completion assembly required for production of oil and/or gas from a hydrocarbon formation surrounding the wellbore.

The isolation valve may comprise a multi-cycle isolation valve. For each target position of a plurality of target positions, the method may comprise repeating the steps of: configuring the isolation valve into the open state; running the completion assembly with the isolation valve in the open state until the downhole end of the completion assembly reaches the target position; injecting a fluid through the throughbore and the isolation valve when the isolation valve is in the open state; configuring the isolation valve into the closed state; and performing a pressure integrity test of the throughbore above the isolation valve.

For each target position of the plurality of target positions, the method may comprise the step of injecting the fluid through the throughbore and the isolation valve when the isolation valve is in the open state before, during and/or after the step of running the completion assembly with the isolation valve in the open state until the downhole end of the completion assembly reaches the target position.

The plurality of target positions may correspond to at least two of: a position before, in, or after, a rotary table; a position before, in, or after, a riser; a position before, in, or after, a blow-out preventer; a position before, in, or after, a tubing hanger; a position before, in, or after, a cased section of the wellbore; a position before, in, or after, an open hole section of the wellbore; and a desired final position of the downhole end of the completion assembly in the wellbore.

The method may comprise injecting a fluid through the throughbore and the isolation valve into the wellbore for displacement of fluid in the wellbore when the isolation valve is in the open state and the downhole end of the completion assembly is located at a desired final position of the downhole end of the completion assembly.

The isolation valve may be configured to receive power from a power source which is provided with the isolation valve.

The power source may comprise a downhole power source.

The isolation valve may be configured to receive power from a power source which is located remotely from the isolation valve. For example, the power source may be provided at or adjacent to surface.

The method may comprise transferring power from the power source to the isolation valve via one or more lines.

The isolation valve may comprise a valve member and an actuator for moving the valve member between an open position corresponding to the open configuration and a closed position corresponding to the closed configuration whilst the actuator receives power from the power source.

The actuator may comprise an electrical actuator and the power source may comprise an electrical power source.

The electrical power source may comprise a battery.

The electrical power source may comprise an electrical generator.

The method may comprise transferring electrical power from the electrical power source to the electrical actuator via one or more electrical conductors.

The actuator may comprise a hydraulic actuator and the power source may comprise a hydraulic power unit.

The method may comprise transferring hydraulic power from the hydraulic power unit to the hydraulic actuator via one or more hydraulic lines.

The isolation valve may comprise a sensor, wherein the sensor is configured to receive power from the power source and the actuator is arranged to move the valve member between the open and closed positions in response to the sensor sensing or detecting a change in the throughbore.

The sensor may comprise a tag reader, and the method may comprise dropping, pumping, injecting or circulating one or more tags along the throughbore into proximity with the tag reader, and causing the actuator to move the valve member between the open and closed positions in response to the tag reader wirelessly detecting the proximity of a tag.

The tag reader may wirelessly detect the proximity of the tag using any wireless communication protocol.

The tag reader may comprise an RFID tag reader and the tag may comprise an RFID tag.

The tag reader may comprise a RUBEE® tag reader, and the tag may comprise a RUBEE® tag.

The sensor may comprise a pressure sensor, and the method may comprise changing the absolute pressure of the fluid in the throughbore to a predetermined absolute pressure and causing the actuator to move the valve member between the open and closed positions in response to the pressure sensor detecting the predetermined absolute pressure.

The sensor may comprise a pressure sensor, and the method may comprise imparting a predetermined pressure variation on a fluid in the throughbore and causing the actuator to move the valve member between the open and closed positions in response to the pressure sensor detecting the predetermined pressure variation.

The predetermined pressure variation may include at least one of: a predetermined pressure modulation; a predetermined pressure waveform; a predetermined property of a pressure waveform; a predetermined amplitude of a pressure waveform; a predetermined frequency of a pressure waveform; a predetermined rate of change of pressure; a predetermined pressure rise time; a predetermined pressure fall time; a predetermined property of a pressure pulse; a predetermined duration of a pressure pulse; a predetermined amplitude of a pressure pulse; a predetermined property of a stream of pressure pulses; a predetermined amplitude of a stream of pressure pulses; a predetermined series of amplitudes of a stream of pressure pulses; a predetermined duty cycle of a stream of pressure pulses; and a predetermined frequency of a stream of pressure pulses.

The isolation valve may comprise a timer such as an electronic timer, wherein the timer is configured to receive power from the power source and the actuator is arranged to move the valve member between the open and closed positions in response to the elapse of a predetermined time period after initiation of the timer.

The method may comprise initiating the timer and causing the actuator to move the valve member between the open and closed positions in response to the timer detecting the elapse of the predetermined time period after initiation.

Initiating the timer may comprise initiating the timer before, during or after running the completion assembly towards or into the wellbore.

Initiating the timer may comprise dropping, pumping, injecting or circulating one or more tags along the throughbore into proximity with the tag reader and causing initiation of the timer in response to the tag reader wirelessly detecting the proximity of a tag.

Initiating the timer may comprise setting or varying a pressure of a fluid in the throughbore and causing initiation of the timer in response to the pressure sensor detecting a predetermined absolute pressure and/or a predetermined pressure variation.

The isolation valve may be configurable between the open and closed states by mechanical engagement with a tool such as a shifting tool or an override tool. For example, the isolation valve may comprise one or more internal features or profiles configured for engagement by such a tool. This may permit the isolation valve to be configured between the open and closed states by mechanical engagement with the tool independently of whether the isolation valve receives power from a power source. This may permit the isolation valve to be configured between the open and closed states by mechanical engagement with the tool when the isolation valve does not receive power from a power source. This may permit the isolation valve to be configured between the open and closed states by mechanical engagement with the tool prior to, or after, expiry of a lifetime of the power source and/or in the event of a failure of an actuator of the isolation valve.

The isolation valve may comprise at least one of a ball valve, a flapper valve and a sliding sleeve valve.

The isolation valve may be located at, adjacent, and/or near the downhole end of the completion assembly.

The completion assembly may comprise a wash shoe. The isolation valve may be located closer to surface than the wash shoe.

The completion assembly may comprise one or more sand screens. The isolation valve may be located further from surface than the sand screen which is located furthest from surface.

The completion assembly may comprise one or more packers. The isolation valve may be located further from surface than the packer which is located furthest from surface.

The method may comprise varying, for example, increasing, the pressure within the throughbore to set one or more packers of the completion assembly once the downhole end of the completion assembly has reached a desired final position in the wellbore or an end of the wellbore.

The completion assembly may comprise a base pipe which defines the throughbore, and one or more ports extending through a sidewall of the base pipe, and wherein the ports are configured to be selectively occluded.

The one or more ports may be configured to allow fluid to flow from a formation surrounding the base pipe into the throughbore. The one or more ports may be configured to allow fluid to flow out of the throughbore into a formation surrounding the base pipe.

The completion assembly may be configured such that any fluid flowing between a formation surrounding the base pipe and the throughbore through one or more of the ports must pass through one or more of the sandscreens.

The completion assembly may comprise one or more port valves, each port valve being configurable between a closed state and an open state for selectively configuring one or more ports between a closed state and an open state.

Each port valve may comprise a bidirectional valve.

Each port valve may comprise a check valve.

Each port valve may comprise a sliding sleeve valve.

Each port valve may comprise a single-cycle valve.

Each port valve may comprise a multi-cycle valve.

Each port valve may comprise a port valve member and an actuator for moving the port valve member between a closed position corresponding to the closed state and an open position corresponding to the open state without any requirement for the port valve to be mechanically engaged by an activation member or a tool whilst the actuator receives power from a power source.

Each port valve may be configured to receive power from a corresponding power source.

Each port valve may be configured to receive power from the same power source.

Each port valve may be configured to receive power from a power source provided with the port valve.

The power source may comprise a downhole power source.

Each port valve may be configured to receive power from a power source located remotely from the port valve. For example, the power source may be provided at or adjacent to surface.

The method may comprise transferring power from the power source to the port valve via one or more lines.

The actuator may comprise an electrical actuator and the power source may comprise an electrical power source.

The electrical power source may comprise a battery.

The electrical power source may comprise a generator.

The method may comprise transferring electrical power from the electrical power source to the electrical actuator via one or more electrical conductors.

The actuator may comprise a hydraulic actuator and the power source may comprise a hydraulic power unit.

The method may comprise transferring hydraulic power from the hydraulic power unit to the hydraulic actuator via one or more hydraulic lines.

Each port valve may comprise a sensor which is configured to receive power from the power source, and wherein the corresponding actuator is arranged to move the port valve member between the closed and open positions in response to the corresponding sensor sensing or detecting a change in the throughbore.

The sensor of each port valve may comprise a tag reader, and the method may comprise dropping, pumping, injecting or circulating one or more tags along the throughbore into proximity with each of the tag readers and causing the actuator to move the port valve member between the closed and open positions in response to the corresponding tag reader wirelessly detecting the proximity of a tag.

The tag reader of each port valve may wirelessly detect the proximity of the tag using any wireless communication protocol.

The tag reader of each port valve may comprise an RFID tag reader and the tag may comprise an RFID tag.

The tag reader of each port valve may comprise a RUBEE® tag reader, and the tag may comprise a RUBEE® tag.

The sensor of each port valve may comprise a pressure sensor, and the method may comprise changing an absolute pressure of the fluid in the throughbore to a predetermined absolute pressure and causing the actuator to move the port valve member between the closed and open positions in response to the corresponding pressure sensor detecting the predetermined absolute pressure.

The sensor of each port valve may comprise a pressure sensor, and the method may comprise imparting a predetermined pressure variation on a fluid in the throughbore and causing the actuator to move the port valve member between the closed and open positions in response to the corresponding pressure sensor detecting the predetermined pressure variation.

The predetermined pressure variation may include at least one of: a predetermined pressure modulation; a predetermined pressure waveform; a predetermined property of a pressure waveform; a predetermined amplitude of a pressure waveform; a predetermined frequency of a pressure waveform; a predetermined rate of change of pressure; a predetermined pressure rise time; a predetermined pressure fall time; a predetermined property of a pressure pulse; a predetermined duration of a pressure pulse; a predetermined amplitude of a pressure pulse; a predetermined property of a stream of pressure pulses; a predetermined amplitude of a stream of pressure pulses; a predetermined series of amplitudes of a stream of pressure pulses; a predetermined duty cycle of a stream of pressure pulses; and a predetermined frequency of a stream of pressure pulses.

Each port valve may comprise a timer such as an electronic timer, wherein the timer is configured to receive power from the power source and the actuator of each port valve is arranged to move the port valve member between the closed and open positions in response to the elapse of a predetermined time period after initiation of the timer, and wherein the method comprises initiating each timer and causing the actuator of each port valve to move the port valve member between the closed and open positions in response to the corresponding timer detecting the elapse of the predetermined time period after initiation.

Initiating each timer may comprise initiating each timer before, during or after running the completion assembly towards or into the wellbore.

Initiating each timer may comprise dropping, pumping, injecting or circulating one or more tags along the throughbore into proximity with each of the tag readers and causing initiation of each timer in response to the corresponding tag reader wirelessly detecting the proximity of a tag.

Initiating each timer may comprise setting or varying a pressure of a fluid in the throughbore and causing initiation of each timer in response to the corresponding pressure sensor detecting a predetermined absolute pressure and/or a predetermined pressure variation.

Each port valve may be configurable between the open and closed states by mechanical engagement with a tool such as a shifting tool or an override tool. For example, each port valve may comprise one or more internal features or profiles configured for engagement by such a tool. This may permit each port valve to be configured between the open and closed states by mechanical engagement with the tool independently of whether each port valve receives power from a power source. This may permit each port valve to be configured between the open and closed states by mechanical engagement with the tool when each port valve does not receive power from a power source. This may permit each port valve to be configured between the open and closed states by mechanical engagement with the tool prior to, or after, expiry of a lifetime of the power source and/or in the event of a failure of an actuator of each port valve.

The completion assembly may comprise one or more port plugs, each port plug being configured to selectively occlude a corresponding port.

Each of the one or more port plugs may comprise a chemically dissolvable plug.

The method may comprise opening the one or more ports by actuating and/or reconfiguring the one or more port valves or the one or more port plugs into an open state once the downhole end of the completion assembly has reached the final position in the wellbore.

The completion assembly may comprise a further isolation valve located closer to surface than the isolation valve.

The method may comprise: running the completion assembly towards or into the wellbore with the further isolation valve in the open state; configuring the further isolation valve into the closed state; and performing a pressure integrity test of the throughbore above the further isolation valve, wherein the further isolation valve is configurable between the open and closed states without any requirement for the further isolation valve to be mechanically engaged by an activation member or a tool whilst the further isolation valve receives power from a power source.

The further isolation valve may comprise any one or more of the same features as the isolation valve.

BRIEF DESCRIPTION OF THE DRAWINGS

Aspects of the present disclosure will now be described by way of non-limiting example only with reference to the following figures of which.

DETAILED DESCRIPTION OF THE DRAWINGS

One skilled in the art will understand that the terms "uphole" and "downhole" are used throughout the description for ease of illustration only, but are not intended to be limiting. The term "uphole" refers to a direction along a wellbore towards a point of entry of the wellbore into a surface such as the ground or the seabed, whilst the term "downhole" refers to a direction along the wellbore away from the point of entry. As such, when a wellbore is deviated from the vertical, such terms may refer to directions which differ significantly from a vertical direction and may even refer to horizontal directions. Similarly, the term "proximate" refers to a position closer to the point of entry, and the term "distal" refers to a position further away from the point of entry.

Figure 1:
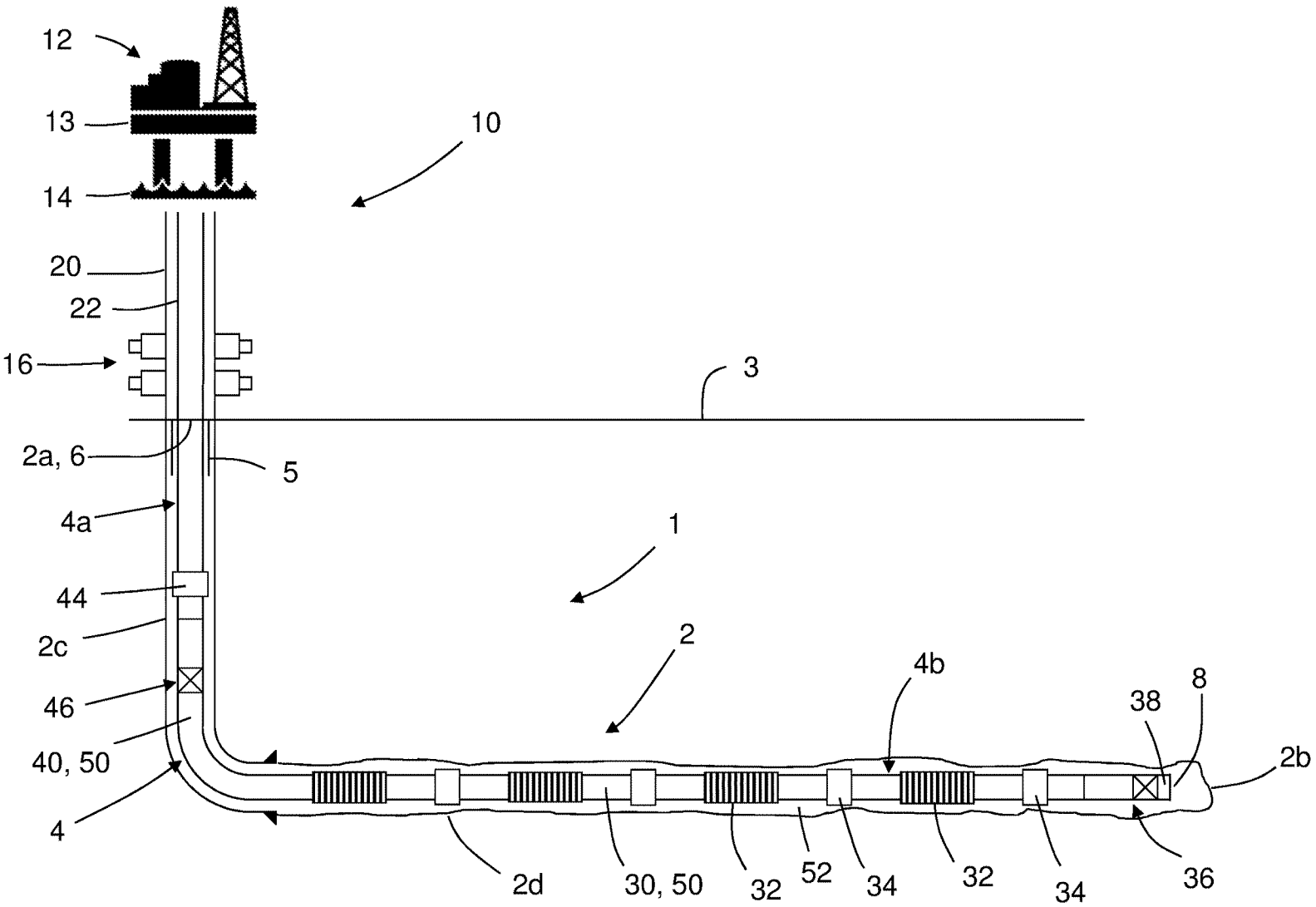
FIG. 1 is a schematic illustration of a subsea oil and gas well during installation of a completion assembly in a wellbore in a single trip into the wellbore and a system for installing the completion assembly in the wellbore.

Referring initially to FIG. 1, there is shown a subsea oil and gas well generally designated 1 including a wellbore 2 extending from an opening or well head 2*a* defined in the seabed 3 to an end or toe 2*b* of the wellbore 2. As shown in FIG. 1, a completion assembly generally designated 4 extends from the well head 2*a* to a position at or near toe 2*b* of the wellbore 2 so that an upper end 6 of the completion assembly 4 engages a tubing hanger 5 located at or near the seabed 3 and a lower or downhole end or toe end 8 of the completion assembly 4 is located at a final position or total depth at or near the toe 2*b* of the wellbore 2. Also shown in FIG. 1 is a system generally designated 10 for installing the completion assembly 4 in the wellbore 2, which system 10 includes a rig 12 located above sea level 14, a blowout preventer 16 located on the seabed 3, a subsea riser 20 extending from the rig 12 to the blowout preventer 16, and a tubing string 22 extending within the subsea riser 20 from the rig 12 to the upper end 6 of the completion assembly 4.

As shown in FIG. 1, the wellbore 2 includes an upper cased section 2*c* and a lower open hole section 2*d*. The completion assembly 4 includes a lower completion assembly 4*b* and an upper completion assembly 4*a* which extends from an upper end of the lower completion assembly 4*b* to the upper end 6 of the completion assembly 4 where the completion assembly 4 is connected to a lower end of the tubing string 22.

The lower completion assembly 4*b* includes a base pipe 30, and a plurality of sand screen sub-assemblies 32 and a plurality of packers 34 arranged around, and distributed along, the base pipe 30. The lower completion assembly 4*b* further includes an isolation valve 36 and a wash shoe 38 located at or adjacent to the downhole end 8 of the completion assembly 4. The upper completion assembly 4*a* includes a base pipe 40, one or more packers 44 arranged around the base pipe 40 and one or more valves including a further isolation valve 46. The base pipes 30, 40 together define an internal throughbore 50 which extends from the upper end 6 of the completion assembly 4 to the downhole end 8 of the completion assembly 4 and an annulus 52 which extends along and around the exterior of the base pipes 30, 40. The tubing string 22 provides a fluid flow path from the rig 12 to the through bore 50.

Figure 2:
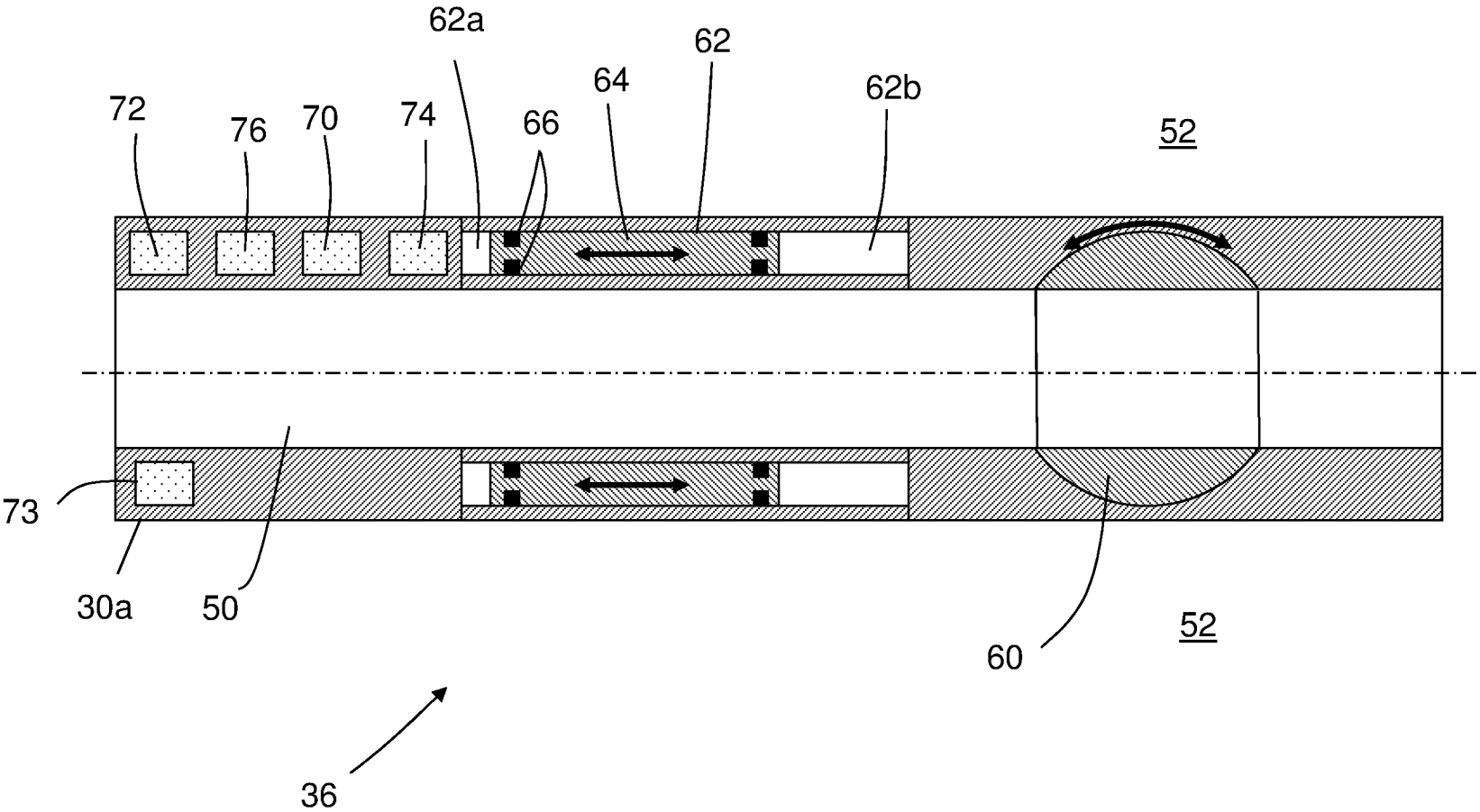
FIG. 2 is a schematic illustration of an isolation valve of the completion assembly of FIG. 1.

As shown in FIG. 2, the isolation valve 36 includes a housing 30*a* which forms part of the base pipe 30 and which defines part of the throughbore 50. The isolation valve 36 includes a ball valve member 60 which is mounted within the housing 30*a* and which is rotatable with respect to the housing 30*a* between an open position shown in FIG. 2 corresponding to an open state of the isolation valve 36 in which the ball valve member 60 permits the flow of fluid along the throughbore 50 and a closed position (not shown) corresponding to a closed state of the isolation valve 36 in which the ball valve member 60 occludes the throughbore 50.

The housing 30*a* defines an annular chamber 62. The isolation valve 36 includes an annular piston 64 which is configured for axial motion within the annular chamber 62. The piston 64 divides the annular chamber 62 into a first portion 62*a* on one axial side of piston 64 and a second portion 62*b* on the other axial side of the piston 64. The piston 64 carries one or more seal members 66 on both its radially inner and radially outer surfaces. Although not shown in FIG. 2, it should be understood that the piston 64 is mechanically connected to the ball valve member 60 via one or more links or arms such that axial translation of the piston 64 within the chamber 62 results in rotation of the ball valve member 60 between the open and closed states.

The isolation valve 36 further includes a power supply in the form of a battery 70, one or more RFID tag readers 72, one or more pressure sensors 73, a hydraulic power unit (HPU) 74, and a controller 76. The battery 70 is configured to provide power to the one or more RFID tag readers 72, the one or more pressure sensors 73, the HPU 74 and the controller 76. The isolation valve 36 includes one or more hydraulic lines or hydraulic fluid flow paths (not shown) extending from the HPU 74 to one or both of the first and second portions 62*a*, 62*b* of the chamber 62. In response to the one or more RFID tag readers 72 detecting a suitably programmed RFID tag (not shown) in the throughbore 50, the controller 76 may control the hydraulic pressure provided by the HPU 74 to one or both of the first and second portions 62*a*, 62*b* of the chamber 62 so as to cause the piston 64 to move axially in the chamber 62 and the ball valve member 62 to rotate from the open state to the closed state. In response to the one or more pressure sensors 73 detecting a predetermined absolute pressure and/or a predetermined pressure variation in the throughbore 50, the controller 76 may control the hydraulic pressure provided by the HPU 74 to one or both of the first and second portions 62*a*, 62*b* of the chamber 62 so as to cause the piston 64 to move axially in the chamber 62 and the ball valve member 62 to rotate from the closed state to the open state.

It should also be understood that the further isolation valve 46 may be identical to the isolation valve 36.

Figure 3:
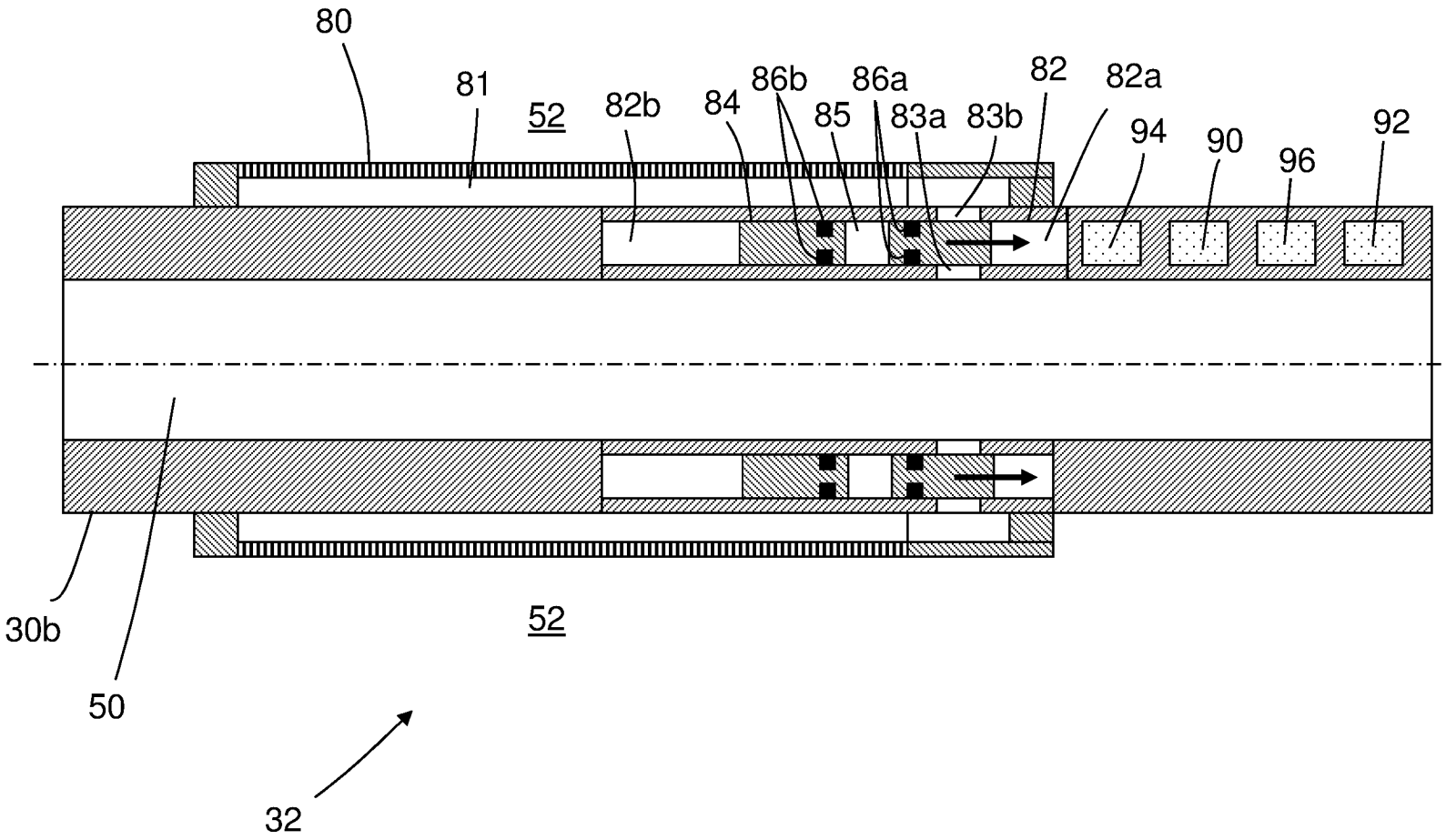
FIG. 3 is a schematic illustration of a central portion of a sand screen sub-assembly of the completion assembly of FIG. 1.

FIG. 3 schematically illustrates a central portion of one of the sand screen sub-assemblies 32. As shown in FIG. 3, the sand screen sub-assembly 32 includes a housing 30*b* which forms part of the base pipe 30 and which defines part of the throughbore 50. The sand screen sub-assembly 32 includes a sand screen 80 which is mounted around the housing 30*b* so as to define an annular region 81 between an outer surface of the housing 30*b* and an inner surface of the sand screen 80. The housing 30*b* further defines an annular chamber 82, one or more radially inner housing fluid ports 83*a* extending from the throughbore 50 into the chamber 82, and one or more radially outer housing fluid ports 83*b* extending from the chamber 82 to the annular region 81.

The sand screen sub-assembly 32 further includes an annular piston 84 which is configured for axial motion within the annular chamber 82. The piston 84 defines one or more ports 85 which extend through a sidewall thereof. The piston 84 divides the annular chamber 82 into a first portion 82*a* on one axial side of piston 84 and a second portion 82*b* on the other axial side of the piston 84. A radially outer surface of the piston 84 carries a first seal member 86*a* on one axial side of the one or more ports 85 and a second seal member 86*b* on the other axial side of the one or more ports 85. Similarly, a radially inner surface of the piston 84 carries a first seal member 86*a* on one axial side of the one or more ports 85 and a second seal member 86*b* on the other axial side of the one or more ports 85.

The sand screen sub-assembly 32 further includes a power supply in the form of a battery 90, one or more RFID tag readers 92, a hydraulic power unit (HPU) 94, and a controller 96. The battery 90 is configured to provide power to the one or more RFID tag readers 92, the HPU 94 and the controller 96. The sand screen sub-assembly 32 includes one or more hydraulic lines or hydraulic fluid flow paths extending from the HPU 94 to one or both of the first and second portions 82*a*, 82*b* of the chamber 82. In response to the one or more RFID tag readers 92 detecting a suitably programmed RFID tag (not shown) in the throughbore 50, the controller 96 may control the hydraulic pressure provided by the HPU 94 to one or both of the first and second portions 82*a*, 82*b* of the chamber 82 so as to move the piston 84 axially in the chamber 82 to an open position (not shown) in which each of the one or more ports 85 of the piston 84 are aligned with a corresponding radially inner housing fluid port 83*a* and a corresponding radially outer housing fluid port 83*b* to thereby establish a fluid flow path from the throughbore 50 to the annular region 81 and the sand screen 80. One of ordinary skill in the art will understand that the sand screen sub-assembly 32 may include one or more features such as one or more keys, locking dogs or the like (not shown) and one or more resilient members (not shown) which serve to lock the piston 84 in the open position once the piston 84 is actuated for the first time. As such, the piston 84 may be considered to operate as a single cycle sliding sleeve valve.

Although not shown in FIG. 3, it should be understood that the sand screen sub-assembly 32 includes one or more of the packers 34.

Use of the completion assembly 4 described with reference to FIGS. 1 to 3 enables the completion assembly 4 to be installed in the wellbore 2 in a single trip. By a "single trip", it should be understood that the completion assembly 4 is progressively assembled and run suspended by the tubing string 22 from the rig 12 so that the downhole end 8 of the completion assembly 4 passes progressively through the riser 20, through the blowout preventer 16, and into the wellbore 2 until the completion assembly 4 is complete with the downhole end 8 of the completion assembly 4 located at the desired final position shown in FIG. 1 such that the completion assembly 4 extends from the upper end 2*a* of the wellbore 2 to the desired final position without any requirement for the lower end of the tubing string 22 to be recovered to the rig 12 to pick up and run one or more additional completion sub-assemblies. As will be appreciated by one of ordinary skill in the art, running the completion assembly into the wellbore 2 in a single trip may save a considerable amount of time and may, therefore, provide a substantial reduction in operating costs.

The method begins with the pick-up of the wash shoe 38, pick up of the isolation valve 36, and connection of the isolation valve 36 to the wash shoe 38. The isolation valve 36 is initially configured with the ball valve member 60 in the open position shown in FIG. 2. The wash shoe 38 is run through a rotary table 13 of the rig 12 followed by the isolation valve 36. A first sand screen sub-assembly 32 is picked up and connected to the isolation valve 36 and run through the rotary table 13. One or more further sand screen sub-assemblies 32 is subsequently picked up and connected to the previous sand screen sub-assembly 32 and run through the rotary table 13 one at a time until the lower completion 4*b* is assembled and extends downwardly though the riser 20 and into the wellbore 2. It should be understood that whilst the completion assembly 4 is being assembled and run into the wellbore 2, the piston 84 of each sand screen sub-assembly 32 is in the closed position shown in FIG. 3 such that the one or more ports 85 of the piston 84 are misaligned with the housing fluid ports 83*a*, 83*b* to thereby prevent the flow of any fluid from the throughbore 50 to the annulus 52 via the sand screen 80.

Similarly, the upper completion assembly 4*a* is assembled and run through the rotary table 13 one sub-assembly at a time including the further isolation valve 46 and the one or more packers 44.

During assembly and running of the lower and upper completions 4*b*, 4*a* towards or into the wellbore 2, it should be understood that a fluid is injected and/or circulated along the throughbore 50 through the isolation valve 36 to the wash shoe 38 where the fluid exits the throughbore 50 into the annulus 52 in the riser 22 or the wellbore 2 to assist travel of the completion assembly 4 along the riser 22 and the well bore 2 i.e. for "washdown" of the completion assembly 4.

During assembly and running of the lower and upper completions 4*b*, 4*a* towards or into the wellbore 2, one or more pressure integrity tests are performed on the throughbore 50 above the isolation valve 36. To initiate each pressure integrity test, one or more suitably programmed RFID tags are dropped, pumped, injected or circulated from the rig 12 through the tubing string or coiled tubing 22 and the throughbore 50 into proximity with the isolation valve 36. Upon the one or more RFID tag readers 72 detecting a suitably programmed RFID tag in the throughbore 50, the controller 76 controls the hydraulic pressure provided by the HPU 74 to one or both of the first and second portions 62*a*, 62*b* of the chamber 62 so as to cause the piston 64 to move axially in the chamber 62 and the ball valve member 60 to rotate from the open position to the closed position. When the ball valve member 60 is in the closed position, one or more pumps at the rig 12 are used to increase the pressure in the throughbore 50 to test the pressure integrity of the throughbore 50 using known techniques.

Once the pressure integrity test is complete, the ball valve member 16 is moved back to the open position shown in FIG. 2. This may be achieved by changing the absolute value of the fluid pressure in the throughbore 50 using one or more pumps at the rig 12 and/or by imparting a variation in the fluid pressure in the throughbore 50 using known techniques. The absolute value of the fluid pressure in the throughbore 50 and/or the variation in the fluid pressure in the throughbore 50 is detected by the pressure sensor 73 and compared to a predetermined absolute fluid pressure stored in the controller 76 and/or a predetermined variation in the fluid pressure stored in the controller 76. If the controller 76 determines that the measured absolute value of the fluid pressure in the throughbore 50 and/or the measured variation in the fluid pressure in the throughbore 50 match the stored predetermined absolute fluid pressure and/or the stored predetermined variation in the fluid pressure, the controller 76 controls the hydraulic pressure provided by the HPU 74 to one or both of the first and second portions 62*a*, 62*b* of the chamber 62 so as to cause the piston 64 to move axially in the chamber 62 and the ball valve member 60 to rotate from the closed position to the open position. If the integrity test is successful, washdown of the completion assembly 4 continues by injecting and/or circulating fluid along the throughbore 50 through the isolation valve 36 and out of the wash shoe 38 as before.

A plurality of such pressure integrity tests are performed as the lower and upper completions 4*b*, 4*a* are assembled and run towards or into the wellbore 2, with each pressure integrity test being performed with the downhole end 8 of the completion assembly 4 located at a corresponding target position in the riser 20 or the wellbore 2. For example, the pressure integrity tests may be performed with the downhole end 8 of the completion assembly 4 located at: a position before, in, or after, a rotary table 13 of the rig 12; a position before, in, or after, the riser 20; a position before, in, or after, the blow-out preventer 16; a position before, in, or after, the tubing hanger 5; a position before, in, or after, a cased section 2*c* of the wellbore 2; a position before, in, or after, an open hole section 2*d* of the wellbore 2; and the desired final position of the downhole end 8 of the completion assembly 4 shown in FIG. 1 to be used for production when the downhole end 8 of the completion assembly 4 has reached total depth at, adjacent or near the toe 2*b* of the wellbore 2.

In view of the foregoing, it will be apparent to one of ordinary skill in the art that the use of the isolation valve 36 not only facilitates washdown of the completion assembly 4 to total depth within the wellbore 2 in a single trip, but also enables one or more pressure integrity tests of the throughbore 50 to be performed when the downhole end 8 of the completion assembly 4 is located at one or more intermediate positions as the completion assembly 4 is run towards the wellbore 2 within the riser 20 and into the wellbore 2 without relying upon high fluid pressures in the throughbore 50 for actuation of the isolation valve 36. Performing one or more such pressure integrity tests of the throughbore 50 in this way, may allow any problems with the completion assembly 4 to be remedied before the completion assembly 4 reaches total depth in the wellbore 2 and thereby reduce the risk of the completion assembly 4 reaching total depth in the wellbore 2 only to discover that pressure integrity is not sufficient to allow packers 34, 44 to be set in the wellbore 2 or so as to compromise fluid displacement in the wellbore 2. One of ordinary skill in the art will appreciate, therefore, that the use of the isolation valve 36 may mitigate against such risks and may, therefore, potentially result in substantial savings in operational time and costs.

Similarly, the further isolation valve 46 may be used to perform a pressure integrity test on the throughbore 50 of the upper completion assembly 4*a* above the further isolation valve 46 as the upper completion assembly 4*a* is progressively assembled and run towards or into the wellbore 2.

Once the completion assembly 4 has reached the desired final position shown in FIG. 1 and, if the final pressure integrity test confirms the pressure integrity of the throughbore 50, one or more pumps at the rig 12 are used to control the fluid pressure in the throughbore 50 so as to set the packers 34 of the lower completion assembly 4*b* and the one or more packers 44 of the upper completion 4*a*. Once the packers 34, 44 are set, one or more suitably programmed RFID tags (not shown) are dropped, pumped, injected or circulated from the rig 12 along the throughbore 50 into proximity with the RFID tag reader 92 of each sand screen sub-assembly 32. In response to the one or more RFID tag readers 92 detecting a suitably programmed RFID tag (not shown) in the throughbore 50, the controller 96 controls the hydraulic pressure provided by the HPU 94 to one or both of the first and second portions 82*a*, 82*b* of the chamber 82 so as to move the piston 84 axially in the chamber 82 to an open position (not shown) in which each of the one or more ports 85 of the piston 84 are aligned with the housing fluid ports 83*a*, 83*b* to thereby establish a fluid flow path from the throughbore 50 to the annulus 52 via the sand screen 80 for the subsequent production of oil and gas from the surrounding formation.

Figure 4:
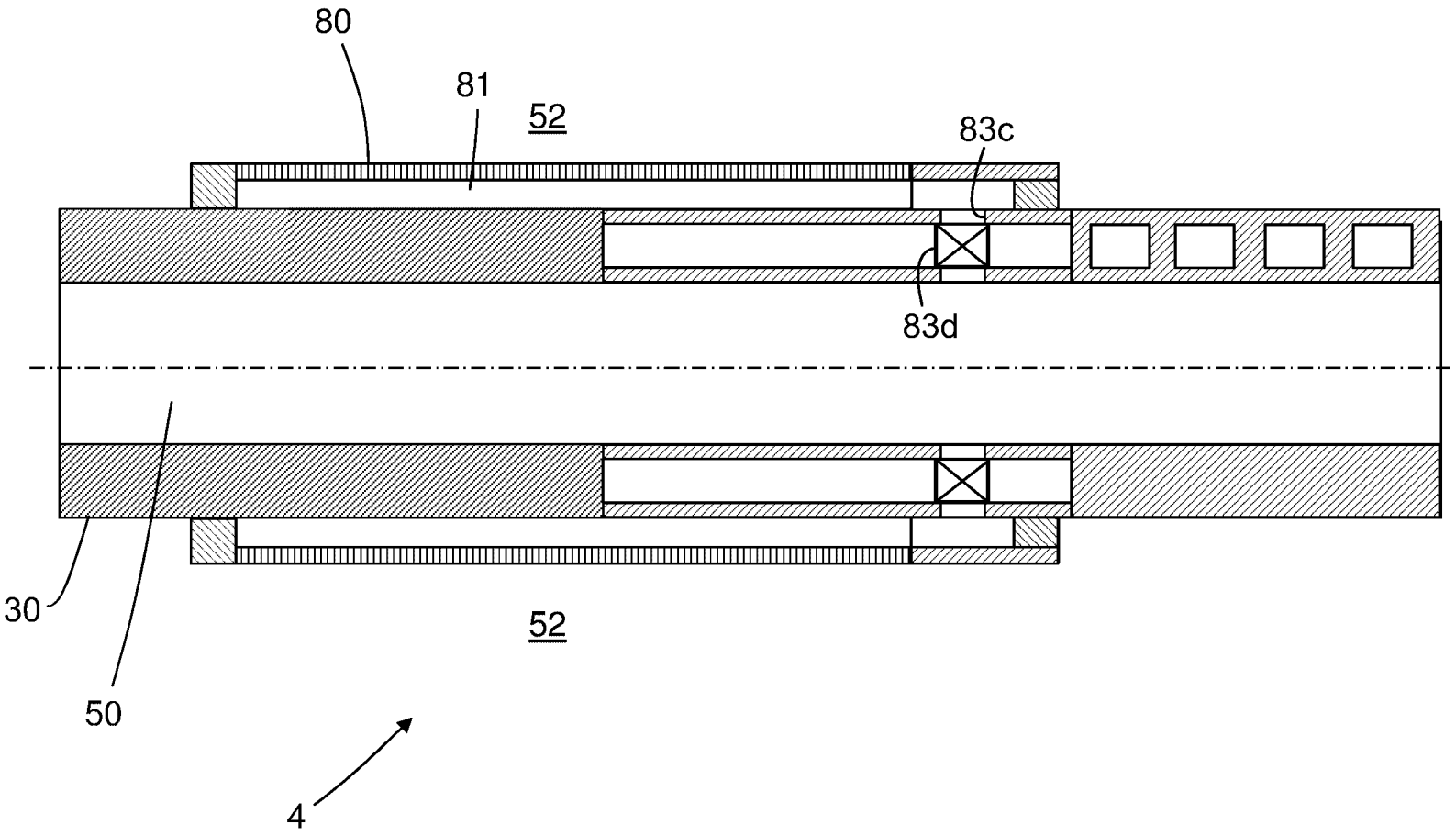
FIG. 4 is another schematic illustration of a portion of the completion assembly.

FIG. 4 is another schematic illustration of a portion of the completion assembly 4. Reference numerals are shown that are similar to those used above with reference to FIGS. 1-3. The completion assembly 4 comprises a base pipe 30 which defines the throughbore 50, and one or more ports 83*c* extending through a sidewall of the base pipe 30. The ports 83*c* are configurable between a closed state to an open state. The completion assembly 4 comprises one or more port plugs 83*d*, each port plug 83*d* being configured to selectively occlude a corresponding port 83*c*. Opening the one or more ports 83*c* is achieved by actuating and/or reconfiguring the one or more port valves or the one or more port plugs 83*d* into an open state once the downhole end of the completion assembly 4 has reached the desired final position in the wellbore (2).

One of ordinary skill in the art will appreciate that modifications of the foregoing systems and methods are possible without departing from the scope of the present disclosure. For example, although the isolation valve 36 has been described as a ball valve, the isolation valve 36 may instead be a flapper valve or a sliding sleeve valve.

The valve member 60 of the isolation valve 36 may be actuated from the closed position to the open position in response to detection of a predetermined pressure variation which includes at least one of: a predetermined pressure modulation; a predetermined pressure waveform; a predetermined property of a pressure waveform; a predetermined amplitude of a pressure waveform; a predetermined frequency of a pressure waveform; a predetermined rate of change of pressure; a predetermined pressure rise time; a predetermined pressure fall time; a predetermined property of a pressure pulse; a predetermined duration of a pressure pulse; a predetermined amplitude of a pressure pulse; a predetermined property of a stream of pressure pulses; a predetermined amplitude of a stream of pressure pulses; a predetermined series of amplitudes of a stream of pressure pulses; a predetermined duty cycle of a stream of pressure pulses; and a predetermined frequency of a stream of pressure pulses.

Although the isolation valve 36 comprises an RFID tag reader 72 and the valve member 60 is moved from the open position to the closed position in response to the RFID tag reader 72 detecting a suitably programmed RFID tag in the throughbore 50 in the proximity of the isolation valve 36, the isolation valve 36 may comprise a wireless tag reader of any kind and the valve member 60 may be moved from the open position to the closed position in response to the wireless tag reader detecting a suitably programmed tag in the throughbore 50 in the proximity of the isolation valve 36. The tag reader may wirelessly detect the proximity of the tag using any wireless communication protocol. For example, the tag reader may comprise a RUBEE® tag reader, and the tag may comprise a suitably programmed RUBEE® tag. (RUBEE is a registered trademark of Visible Assets, Inc.)

Moreover, although the valve member 60 of the isolation valve 36 is moved from the open position to the closed position in response to the RFID tag reader 72 detecting a suitably programmed RFID tag in the throughbore 50 in the proximity of the isolation valve 36, and the valve member 60 of the isolation valve 36 is actuated from the closed position to the open position in response to the pressure sensor 73 detecting a predetermined absolute pressure or a predetermined pressure variation in the throughbore 50 at the isolation valve 36, it should be understood that other arrangements of the isolation valve 36 are possible which do not require the isolation valve 36 to be mechanically engaged by an activation member or a tool. For example, the valve member 60 of the isolation valve 36 may be moved from the open position to the closed position in response to the pressure sensor 73 detecting a predetermined absolute pressure or a predetermined pressure variation in the throughbore 50 at the isolation valve 36, and the valve member 60 of the isolation valve 36 may be moved from the closed position to the open position in response to the RFID tag reader 72 detecting a suitably programmed RFID tag in the throughbore 50 in the proximity of the isolation valve 36.

Additionally or alternatively, the controller 76 may include a timer such as an electronic timer which is programmed so as to cause the actuator to move the valve member 60 of the isolation valve 36 between the open and closed positions after the elapse of a predetermined time period from initiation of the timer. The timer may be initiated at the time of assembly of the isolation valve 36 at the rotary table of the rig 12 before the isolation valve 36 is run into the riser 20. Additionally or alternatively, the timer may be initiated in response to the RFID tag reader 72 detecting a suitably programmed RFID tag in the throughbore 50 in the proximity of the isolation valve 36 and/or in response to the pressure sensor 73 detecting a predetermined absolute pressure or a predetermined pressure variation in the throughbore 50 at the isolation valve 36.

Moreover, although the isolation valve 36 does not require to be mechanically engaged by an activation member or a tool for configuration of the isolation valve 36 between the open and closed states, the isolation valve 36 may define on or more internal features and/or profiles for mechanical engagement by a shifting or override tool for reconfiguration of the isolation valve 36 between the open and closed states. Such internal features and/or profiles may provide an override capability which may be used in the event that the isolation valve 36 cannot be opened remotely without mechanically engaging the isolation valve 36 by an activation member or a tool or after expiry of the lifetime of the battery 70 of the isolation valve 36.

Although each sand screen sub-assembly 32 has been described as a having one or more ports 85, 83*a*, 83*b* and a single-cycle RFID-actuated sliding sleeve port valve in the form of the RFID-actuated sliding piston 84 for selectively occluding the one or more ports 85, 83*a*, 83*b*, it should also be understood that one or more of the sand screen sub-assemblies 32 may include a port valve of any kind including, but not limited to, a bidirectional valve, a check valve, a single-cycle valve of any kind, and a multi-cycle valve. Each sand screen sub-assembly 32 may include a port valve which is configurable between an open state and a closed state without any requirement for the port valve to be mechanically engaged by an activation member or a tool. For example, each sand screen sub-assembly 32 may include a port valve which is configurable between an open state and a closed state in response to detection of a predetermined absolute pressure and/or a predetermined pressure variation. Each sand screen sub-assembly 32 may include one or more port plugs, each port plug being configured to selectively occlude a corresponding port. Each of the one or more port plugs may include a chemically dissolvable plug.

Although each sand screen sub-assembly 32 has been described as a having one or more ports 85, 83*a*, 83*b* and a single-cycle RFID-actuated sliding sleeve port valve having an RFID tag reader, each sliding sleeve port valve may comprise a wireless tag reader of any kind and the sliding sleeve port valve may be moved from the closed position to the open position in response to the wireless tag reader detecting a suitably programmed tag in the throughbore 50 in the proximity of the sliding sleeve port valve. The tag reader of the sliding sleeve port valve may wirelessly detect the proximity of the tag using any wireless communication protocol. For example, the tag reader of the sliding sleeve port valve may comprise a RUBEE® tag reader and the tag may comprise a suitably programmed RUBEE® tag.

One of ordinary skill in the art will also appreciate that whilst the foregoing methods have been described in the context of a subsea oil and gas well 1, the same methods may be used in the context of a subterranean oil and gas well of any kind and, in particular, an oil and gas well extending from a wellhead at ground level.

The invention claimed is:

1. A method for use in installing a completion assembly in a wellbore in a single trip into the wellbore, the completion assembly defining a throughbore and comprising:

a multi-cycle isolation valve which is configurable between an open state in which the isolation valve permits fluid to flow through the throughbore and a closed state in which the isolation valve prevents fluid from flowing through the throughbore, a base pipe which defines the throughbore, and one or more ports extending through a sidewall of the base pipe, wherein the ports are configurable between a closed state to an open state, and one or more port plugs, each port plug being configured to selectively occlude a corresponding port;

the method comprising:

running the completion assembly into the wellbore with the isolation valve in the open state until a downhole end of the completion assembly reaches one target position of a plurality of target positions in the wellbore;

injecting a fluid through the throughbore and the isolation valve when the isolation valve is in the open state;

configuring the isolation valve into the closed state;

performing a pressure integrity test of the throughbore above the isolation valve;

further running the completion assembly with the insolation valve in the open state until the downhole end of the completion assembly reaches a second target position of the plurality of target positions in the wellbore;

repeating the injecting, configuring, performing and further running steps for each target position of the plurality of target positions; and wherein the isolation valve is configurable between the open and closed states without any requirement for the isolation valve to be mechanically engaged by an activation member or a tool whilst the isolation valve receives power from a power source.

2. The method according to claim 1, comprising injecting the fluid through the throughbore and the isolation valve when the isolation valve is in the open state before, during and/or after running the completion assembly towards or into the wellbore.

3. The method according to claim 1, wherein, when the downhole end of the completion assembly is located at the target position, the completion assembly extends from a head of the wellbore to the target position.

4. The method according to claim 1, comprising running the completion assembly with the isolation valve in the open state from a head of the wellbore until the downhole end of the completion assembly reaches the target position in the wellbore in a single trip into the wellbore.

5. The method according to claim 1, wherein, for each target position of the plurality of target positions, the method comprises the step of injecting the fluid through the throughbore and the isolation valve when the isolation valve is in the open state before, during and/or after the step of running the completion assembly with the isolation valve in the open state until the downhole end of the completion assembly reaches the target position.

6. The method according to claim 1, comprising injecting a fluid through the throughbore and the isolation valve into the wellbore for displacement of fluid in the wellbore when the isolation valve is in the open state and the downhole end of the completion assembly is located at a desired final position of the downhole end of the completion assembly.

7. The method according to claim 1, wherein the isolation valve is configured to receive power from a power source which is at least one of provided with the isolation valve and located remotely from the isolation valve and/or which is provided at, or adjacent to, surface.

8. The method according to claim 1, wherein the isolation valve comprises a valve member and an actuator for moving the valve member between an open position corresponding to the open configuration and a closed position corresponding to the closed configuration whilst the actuator receives power from the power source.

9. The method according to claim 8, wherein the isolation valve comprises a sensor, the sensor is configured to receive power from the power source and the actuator is arranged to move the valve member between the open and closed positions in response to the sensor sensing or detecting a change in the throughbore.

10. The method according to claim 9, wherein the sensor comprises a tag reader, and the method comprises dropping, pumping, injecting or circulating one or more tags along the throughbore into proximity with the tag reader and causing the actuator to move the valve member between the open and closed positions in response to the tag reader wirelessly detecting the proximity of one or more of the tags.

11. The method according to claim 9, wherein the sensor comprises a pressure sensor, and the method comprises at least one of:

changing an absolute pressure of the fluid in the throughbore to a predetermined absolute pressure and causing the actuator to move the valve member between the open and closed positions in response to the pressure sensor detecting the predetermined absolute pressure; and imparting a predetermined pressure variation on a fluid in the throughbore and causing the actuator to move the valve member between the open and closed positions in response to the pressure sensor detecting the predetermined pressure variation.

12. The method according to claim 8, wherein the isolation valve comprises a timer which is configured to receive power from the power source and the actuator is arranged to move the valve member between the open and closed positions in response to the elapse of a predetermined time period after initiation of the timer, and wherein the method comprises initiating the timer and causing the actuator to move the valve member between the open and closed positions in response to the timer detecting the elapse of the predetermined time period after initiation.

13. The method according to claim 1, wherein the completion assembly comprises one or more sand screens and the isolation valve is located further from surface than the sand screen which is located furthest from surface.

14. The method according to claim 1, wherein the completion assembly comprises one or more packers and the isolation valve is located further from surface than the packer which is located furthest from surface.

15. The method according to claim 1, comprising increasing the pressure within the throughbore to set one or more packers of the completion assembly once the downhole end of the completion assembly has reached a desired final position in the wellbore.

16. The method according to claim 1, wherein the completion assembly comprises one or more port valves, each port valve being configurable between a closed state and an open state for selectively configuring the one or more ports between a closed state and an open state.

17. The method according to claim 16, comprising opening the one or more ports by actuating and/or reconfiguring the one or more port valves or the one or more port plugs into an open state once the downhole end of the completion assembly has reached the desired final position in the wellbore.

18. The method according to claim 16, wherein each port valve comprises a port valve member and an actuator for moving the port valve member between a closed position corresponding to the closed state and an open position corresponding to the open state without any requirement for the port valve to be mechanically engaged by an activation member or a tool whilst the actuator receives power from a power source.

19. The method according to claim 18, wherein each port valve comprises a sensor which is configured to receive power from the power source and, wherein the corresponding actuator is arranged to move the port valve member between the closed and open positions in response to the sensor sensing or detecting a change in the throughbore.

20. The method according to claim 19, wherein the sensor of each port valve comprises a tag reader, and the method comprises dropping, pumping, injecting or circulating one or more tags along the throughbore into proximity with the tag reader and causing the actuator to move the port valve member between the closed and open positions in response to the tag reader wirelessly detecting the proximity of one or more of the tags.

21. The method according to claim 1, wherein the completion assembly comprises:

a further isolation valve located closer to surface than the isolation valve, and the method comprises:

running the completion assembly towards or into the wellbore with the further isolation valve in the open state;

configuring the further isolation valve into the closed state; and performing a pressure integrity test of the throughbore above the further isolation valve, wherein the further isolation valve is configurable between the open and closed states without any requirement for the further isolation valve to be mechanically engaged by an activation member or a tool whilst the further isolation valve receives power from a power source.

22. The method according to claim 1, wherein the completion assembly comprises a wash shoe and the isolation valve is located closer to the surface than the wash shoe.

* * * * *